United States Patent [19]

Sakuragi et al.

[11] Patent Number: 5,042,437

[45] Date of Patent: Aug. 27, 1991

[54] ROCKER ARM ARRANGEMENT FOR VARIABLE TIMING VALVE TRAIN

[75] Inventors: Shigeru Sakuragi; Yutaka Matayoshi; Shigeo Muranaka, all of Yokosuka, Japan

[73] Assignee: Nissan Motor Company, Japan

[21] Appl. No.: 606,966

[22] Filed: Oct. 31, 1990

[30] Foreign Application Priority Data

Nov. 2, 1989 [JP] Japan ..... 1-286623

[51] Int. Cl.[5] ..... F01L 1/34

[52] U.S. Cl. ..... 123/90.16; 123/90.39

[58] Field of Search ..... 123/90.15, 90.16, 90.39, 123/90.4, 90.41

[56] References Cited

U.S. PATENT DOCUMENTS

| | | | |
|---|---|---|---|
| 4,768,467 | 9/1988 | Yamada et al. | 123/90.17 |
| 4,799,463 | 1/1989 | Konno | 123/90.16 |
| 4,883,027 | 11/1989 | Oikawa et al. | 123/90.16 |
| 4,887,563 | 12/1989 | Ishida et al. | 123/90.16 |
| 4,899,701 | 2/1990 | Inoue et al. | 123/90.16 |

FOREIGN PATENT DOCUMENTS

| | | |
|---|---|---|
| 63-57805 | 3/1988 | Japan . |
| 63-167016 | 7/1988 | Japan . |
| 63-45521 | 11/1988 | Japan . |

*Primary Examiner*—David A. Okonsky
*Assistant Examiner*—Weilun Lo
*Attorney, Agent, or Firm*—Lowe, Price, LeBlanc & Becker

[57] ABSTRACT

A variable valve timing type rocker arm arrangement is arranged so that, in the absence of sufficient hydraulic pressure to operate the interlocking mechanisms which switch the valve lift control from one cam follower to another, it defaults to a cam follower suited for low speed engine operation rather than one which is adapted to maximize fuel economy. During engine starts (when oil pump output is inherently low) the initial low speed cam follower defaulting improves aspiration and reduces the tendency for incomplete combustion to induce the formation of smoldering deposits on the spark plug electrodes. In the event of an actual hydraulic system malfunction, the defaulting enable the engine to produce enough torque to render the vehicle drivable.

8 Claims, 6 Drawing Sheets

| ENG.MODE | CONDUIT 49 PRESS. | CONDUIT 39 PRESS. |
|---|---|---|
| I | Hi | Low |
| II (START) | Low | Low |
| III | Low | Hi |

ROCKER ARM ARRANGEMENT FOR VARIABLE TIMING VALVE TRAIN

BACKGROUND OF THE INVENTION

1. Field of the Invention

The present invention relates generally to an engine valve train and more specifically to a variable valve timing arrangement which permits the lift and/or timing of the valves to be selectively varied.

2. Description of the Prior Art

JP-A-63-167016 and JP-A-63-57805 disclose rocker arm arrangements which include a main rocker arm which cooperates with a low speed cam and a sub-rocker arm which cooperates with a high speed cam. The two rocker arms are pivotally mounted on a common rocker arm shaft.

A hydraulically operated connection or interlocking device which enables the main and sub-rocker arms to be selectively locked together, comprises a set of plunger bores which are formed in the rocker arms in a manner to be parallel with and at a predetermined distance from, the axis of the shaft about which the arms are commonly pivotal. By applying a hydraulic pressure to the end or ends of the plungers reciprocally disposed in the bores, the plungers can be induced to move axially and induce the situation wherein two of the plungers will partially enter an adjacent bore and lock the two arms together.

However, these type of arrangement have suffered from the drawback that when the engine is being started the amount of hydraulic pressure produced by the engine oil pump is so low that sufficient bias cannot be produced to bias the plungers into their respective locking positions, the rocker arms cannot be locked together in a manner which prevents the relative movement therebetween.

This leads to the situation wherein, if the main rocker arm is arranged to be initially motivated by a so called "partial" cam (viz., a cam which features a profile designed to reduce the fuel consumption), the adiabatic expansion of the fuel during the induction phase is such that the ignition of the air-fuel charge is difficult and/or leads to incomplete combustion and formation of smouldering deposits on the spark plug terminals during start-up of a cold engine.

A further problem come in that, if a so called partial cam is used and the hydraulic control system malfunctions in a manner wherein an adequate level of hydraulic pressure cannot be supplied to the interlocking device, the amount of torque produced by the engine falls to a level wherein vehicle drivability is badly deteriorated.

Accordingly, it is extremely difficult in view of the above conflicting requirements, to set the profile of the cam which is initially used to motivate the rocker arm in a manner which suitably achieves the desired fuel economical operation during very low engine speed operation while enabling the engine to be readily started and/or produce adequate amounts of torque in the event of hydraulic failure.

OBJECT OF THE INVENTION

It is an object of the present invention to provide a variable valve timing type rocker arm arrangement which, in the absence of sufficient hydraulic pressure to operate the interlocking mechanisms which control the changes in valve lift, defaults to a cam/follower arrangement which is suited for low engine operation and improves the respiration of the engine during cranking and/or engine start as compared with a partial cam/follower arrangement which is designed to maximize fuel economy.

In brief, the above object is achieved by an arrangement wherein, in the absence of sufficient hydraulic pressure to operate the interlocking mechanisms which switch the valve lift control from one cam follower to another, it defaults to a cam follower suited for low speed engine operation rather than one which is adapted to maximize fuel economy. During engine starts (when oil pump output is inherently low) the initial low speed cam follower defaulting improves aspiration and reduces the tendency for incomplete combustion to induce the formation of smouldering deposits on the spark plug electrodes. In the event of an actual hydraulic system malfunction, the defaulting enable the engine to produce enough torque to render the vehicle drivable.

More specifically, a first aspect of the invention comes in an internal combustion engine which features: a cam shaft having first, second and third cams; a rocker arm; a first cam follower which is reciprocatively mounted on the rocker arm and arranged to engage the first cam; a first interlocking device for selectively locking the first cam follower to the rocker arm and preventing relative movement therebetween in response to a first hydraulic signal having a first predetermined level; a second cam follower which is reciprocatively mounted on the rocker arm and arranged to engage the second cam; a second interlocking device for selectively locking the second cam to the rocker arm and preventing relative movement therebetween in response to the absence of a second hydraulic signal having a second predetermined level; and a third cam follower which is fixedly mounted on the rocker arm and arranged to engage the third cam.

A second aspect of the invention comes in an internal combustion engine which features: a cam shaft; first, second and third cams on the cam shaft, the first cam being adapted to produce valve lift suited for high speed engine operation, the second cam being adapted to produce valve lift suited from low engine speed operation and the third cam being adapted to produce partial lift which is suited for optimizing fuel economy; a rocker arm; a first cam follower which engages the first cam and which is relatively movable with respect to the rocker arm; a first interlocking device which normally permits relative movement between the first cam follower and the rocker arm, the first interlocking device locking the first cam follower to the rocker arm and preventing relative movement therebetween in response to a first predetermined hydraulic signal; a second cam follower engages the second cam and which is relatively movable with respect to the rocker arm; a second interlocking device which normally locks the second cam follower to the rocker arm and prevents relative movement therebetween, the second interlocking device releasing the second cam follower and permitting relative movement between the second cam follower and the rocker arm in response to a second predetermined hydraulic signal; and a third cam follower which is fixedly mounted on the rocker arm and arranged to engage the third cam.

DETAILED DESCRIPTION OF THE PREFERRED EMBODIMENTS

Figure 1:
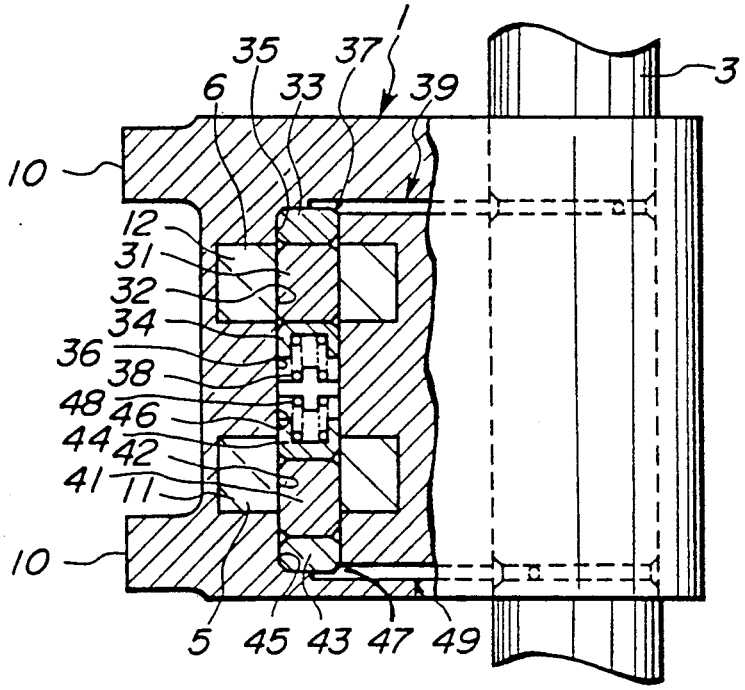
FIG. 1 is a plan view partially in section showing the construction which characterizes a first embodiment of the present invention.
Figure 2:
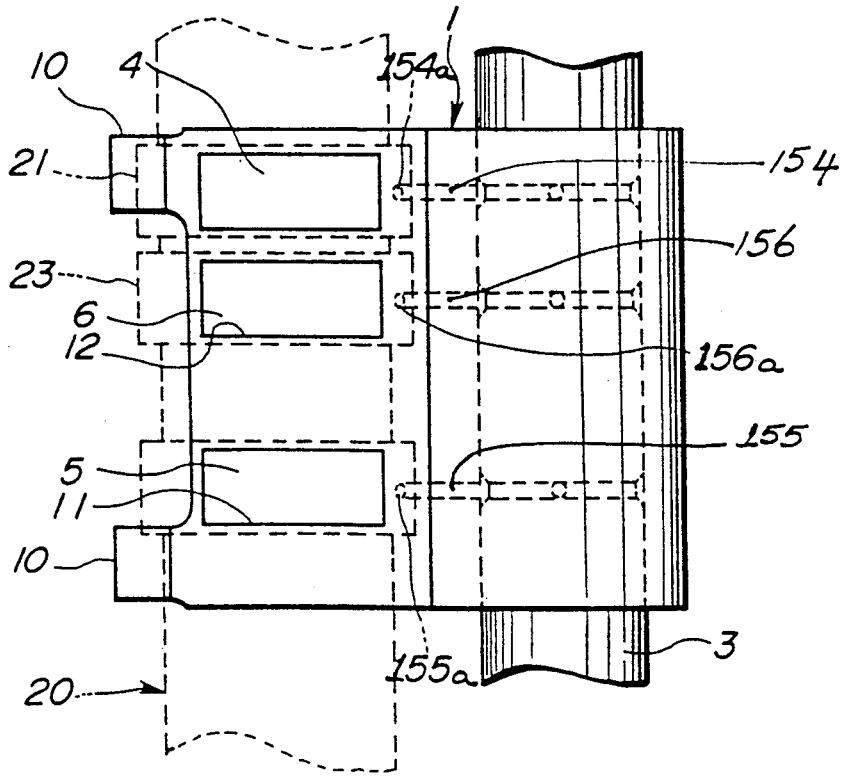
FIG. 2 is a similar plan view wherein the sectioning has been omitted and which shows the disposition of the cam three followers utilized.
Figure 3:
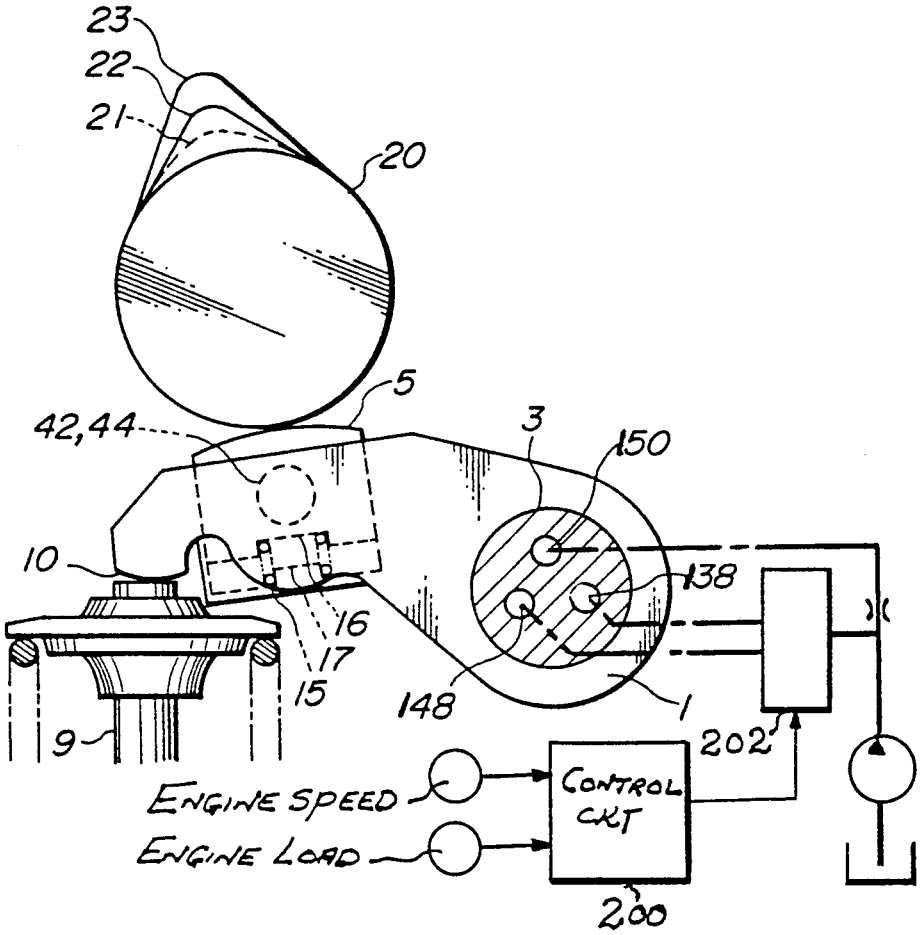
FIG. 3 is an elevational view of the embodiment shown in FIGS. 1 and 2.

FIGS. 1 to 3 show a rocker arm arrangement according to an embodiment of the present invention. As will be appreciated this rocker arm 1 is arranged to simultaneously lift two poppet valves 9 which can be associated with either the induction or exhaust system of an internal combustion engine.

The rocker arm is formed so as to be essentially square as seen in plan and is pivotally mounted on a rocker shaft 3 which is rigidly supported on a cylinder head (not shown). Valve engagement portions 10 which project from the two corners of the arm are arranged to engage the tops of the stems of valves 9 in the manner best seen in FIG. 3.

A first cam follower 4 is fixedly connected the upper surface of the rocker arm 1 (e.g. formed integrally with the rocker arm). This follower is arranged to engage a "partial" cam 21 which has a profile of the nature shown in FIG. 3 and which is designed to produce relatively small lift characteristics.

Second and third relatively displaceable cam followers 5 and 6 are reciprocatively mounted in suitable bores formed in the rocker arm 1 and arranged to engage low speed and high speed cams 22, 23 which have profiles designed to produce lift characteristics suited for low and high speed engine operation, respectively.

Figure 4:
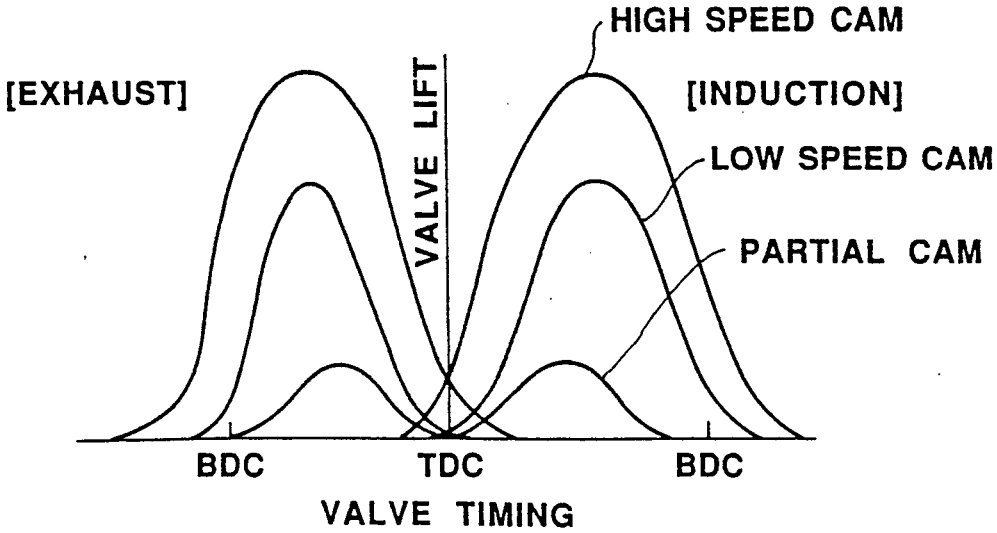
FIG. 4 is a graph which shows in terms of valve lift crank angle the valve lift characteristics provided by the partial cam, low speed cam and the high speed cam, during exhaust and induction modes.

Each of the first, second and third cams 21, 22 and 23 are provided (integrally formed) on a single cam shaft 20 and are arranged in a manner to directly engage the respective followers 4, 5 and 6. The lift characteristics provided by these cams is illustrated in FIG. 4.

The cam followers and the bores in which they are respectively received, have rectangular cross-sections. The bores or cylinders (as they will be referred to hereinafter) are formed in a manner that the center lines thereof pass through the axis of rotation of the cam shaft 20 when the cam followers 4–6 are in engagement which the base circles of the cams 21–23. This arrangement promotes smooth reciprocation of the cams within the cylinders.

The two reciprocal cam followers 5 and 6 are engaged by lost motion springs 15. In this embodiment the springs are coil types. The upper ends are received in shallow blind bores 16 formed in the lower surfaces of the followers, while the lower ends are received on projections 17 formed at the bottom of the cylinders.

A high speed cam follower interlocking device comprises a pin 31 is reciprocatively received in a cylindrical through bore 32 formed in what shall be referred to the piston portion of the high speed cam follower 6. Two coaxially aligned bores 35, 36 are formed in the rocker arm 1 so as to be parallel with the axis of the rocker shaft and arranged to open on diametrically opposed sides of the rectangular cylinder. These bore align with the bore formed in the high speed cam follower piston when the cam follower engages the base circle of the high speed cam 23.

A piston 33 is reciprocatively disposed in the bore 35 and in manner to define a hydraulic chamber 37. A spring cap 34 is reciprocatively received in the bore 36 and encloses a return spring 38 therein. This return spring produces a bias which in the absence of a predetermined hydraulic pressure in the hydraulic chamber 37 holds pin 31, piston 33 and spring cap 34 in the illustrated positions wherein the cam follower piston portion is permitted to reciprocate within its cylinder.

On the other hand, when a hydraulic pressure is supplied into the hydraulic chamber 37 in a manner which produce a bias which overcomes the force of the return spring 38, the three elements move axially in a manner wherein the piston 33 and the pin 31 partially project into an adjacent bore and thus lock the high speed cam follower against reciprocation in its cylinder.

The low speed cam follower 5 is provided with an interlocking device which is basically similar to that used with the high speed cam follower. However, in this instance the device is arranged so that in the absence of the a sufficient hydraulic pressure in hydraulic chamber 47, the spring cap 41 is biased to project out of bore 46 so that the pin 41 and spring cap 44 project into bores 42 and 45 respectively. Under these conditions the low speed cam follower is locked against reciprocation.

On the other hand, when a sufficiently high hydraulic pressure is induced to prevail in the hydraulic chamber 47 and the low speed cam follower 5 is in engagement with the base circle of the low speed cam 22, the piston 43 drives the pin and spring cap 41, 44 back into their respective bores 42, thus releasing the interlocking and inducing conditions wherein the low speed cam follower piston portion may reciprocated in its rectangular cylinder against the bias of the lost motion spring 15 which is disposed thereunder.

The bores in which the return springs 38, 48 are enclosed by spring caps 34, 44 are vented by way of vent port not shown.

The hydraulic chambers 37, 47 communicate with control passages 39, 49 respectively. These passages lead to grooves formed in the rocker shaft which in turn communicate with axially extending oil gallery passages 138 and 148 respectively.

The rocker shaft 3 is further formed with a lubrication oil supply passage 150. The rocker arm 1 is formed with three lubrication passages 154, 155 and 156 which lead from radial grooves formed in the rocker shaft 3 to lubrication oil outlets **154*a*, 155*a* and 156*a*. The above mentioned radial grooves communicate with the passage 150** by way of radial bores (no numeral).

Figures 5, 6:
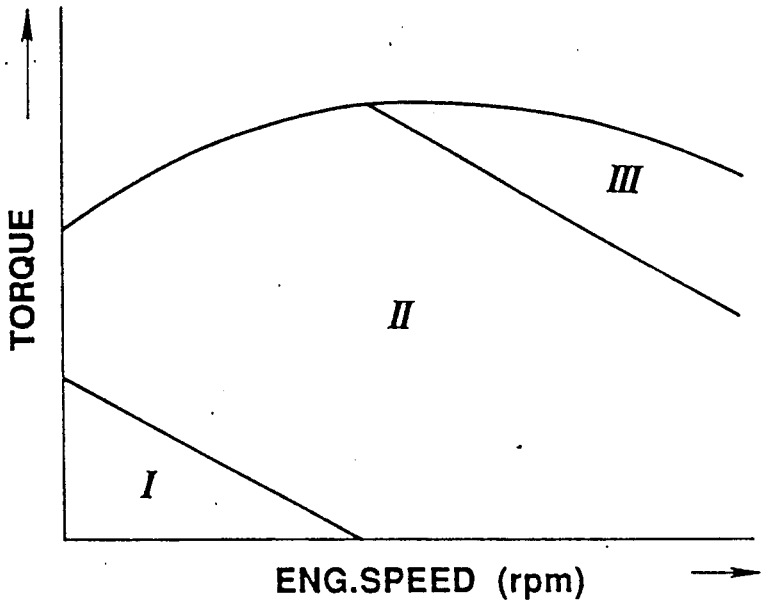
FIG. 5 is a map which shows in terms of engine speed and engine torque, the three zones for which the, partial, low and high speed cams are used.
FIG. 6 is a table which shows the level to which the hydraulic pressure in the control lines which lead to the two interlocking devices utilized in the embodiment of the invention, are controlled for each of the above mentioned three engine operational zones.

A control unit 200 is arranged to be responsive to inputs indicative of engine speed and load and to contain map type data of the nature shown in FIGS. 5 and 6. The control unit 200 is arranged to issuing controlling signal(s) to a valve unit 202 containing an electromagnetic valve or valves which control the supply of pressurized hydraulic fluid into the oil gallery passages 138 and 148. As will be appreciated from FIG. 6 a single switching valve alone would suffice.

OPERATION

When the engine is operating in a manner wherein the engine load and speed characteristics which fall in the partial mode zone I, the electromagnetic valve 202 is conditioned to pressurize conduit 49 and drain conduit 39. Under these conditions piston 43 is induced to move the pin 41 to a position wherein the low speed cam follower 5 is unlocked and rendered reciprocal against the bias of the lost motion spring 15.

This conditions the rocker arm so that it is driven by the engagement between the partial cam 21 and the partial cam follower 4. Viz., under these conditions the low and high speed cam followers are both rendered relatively movable with respect to the rocker arm and thus the engagements with the low and high speed cams 22, 23 produces no rocker arm motivation.

Upon the engine speed and load values entering the low speed zone II the control unit 200 conditions the valve 202 to drain both of the control conduits 39, 49 and thus enable the high and low speed interlocking devices to assume the condition illustrated in FIG. 1. In this instance the low speed cam follower 5 is locked against reciprocation while the high speed one remains released. Under these conditions the valves 9 are lifted in accordance with the engagement between the low speed cam follower 5 and the low speed cam 22.

As will be appreciated, the low speed cam 22 provides a larger amount of lift than the partial cam. Further, when the engine is being cranked and/or is being started, as the amount of hydraulic pressure available for controlling the high and low speed cam follower interlocking devices is minimal or zero, the interlocking devices automatically default the condition shown in FIG. 1 wherein lift is provided by the slow speed cam 22. Accordingly, initial engine aspiration is improved as compared with the partial mode of operation and desirable ignition characteristics of the air-fuel charge is facilitated.

When the engine speed and load values fall in the high speed zone III the control unit 200 conditions the valve 202 to drain the oil gallery passage 138 and to pressurize oil gallery passage 148. This locks the high speed cam follower 6 and thus induces the lift of the valves 9 to be determined by the high speed cam 23. It will be noted that even though the low speed cam follower is still locked in place, the lift characteristics of the high speed cam eliminate the need to release the low speed cam follower.

Of course it is within the scope of the present invention to supply both of the oil gallery passages 138 and 148 with pressurized hydraulic fluid in the event that such should be required.

When the engine speed and load characteristics fall in the partial zone I oil gallery passage 138 is drained and oil gallery passage 148 is pressurized. This unlocks the low speed cam follower and thus places the lifting of the valves under the control of the partial cam 21 which engages the fixed partial cam follower 4.

The profile of the partial cam 21 is selected to reduce the amount fuel consumption under low engine speed operating conditions, while the low and high speed cam profiles are designed to improve the engine torque output. Accordingly, as the engine speed increases from a low level, the amount of torque which is generated by the engine is induced to increase in a desirable manner.

Figure 7:
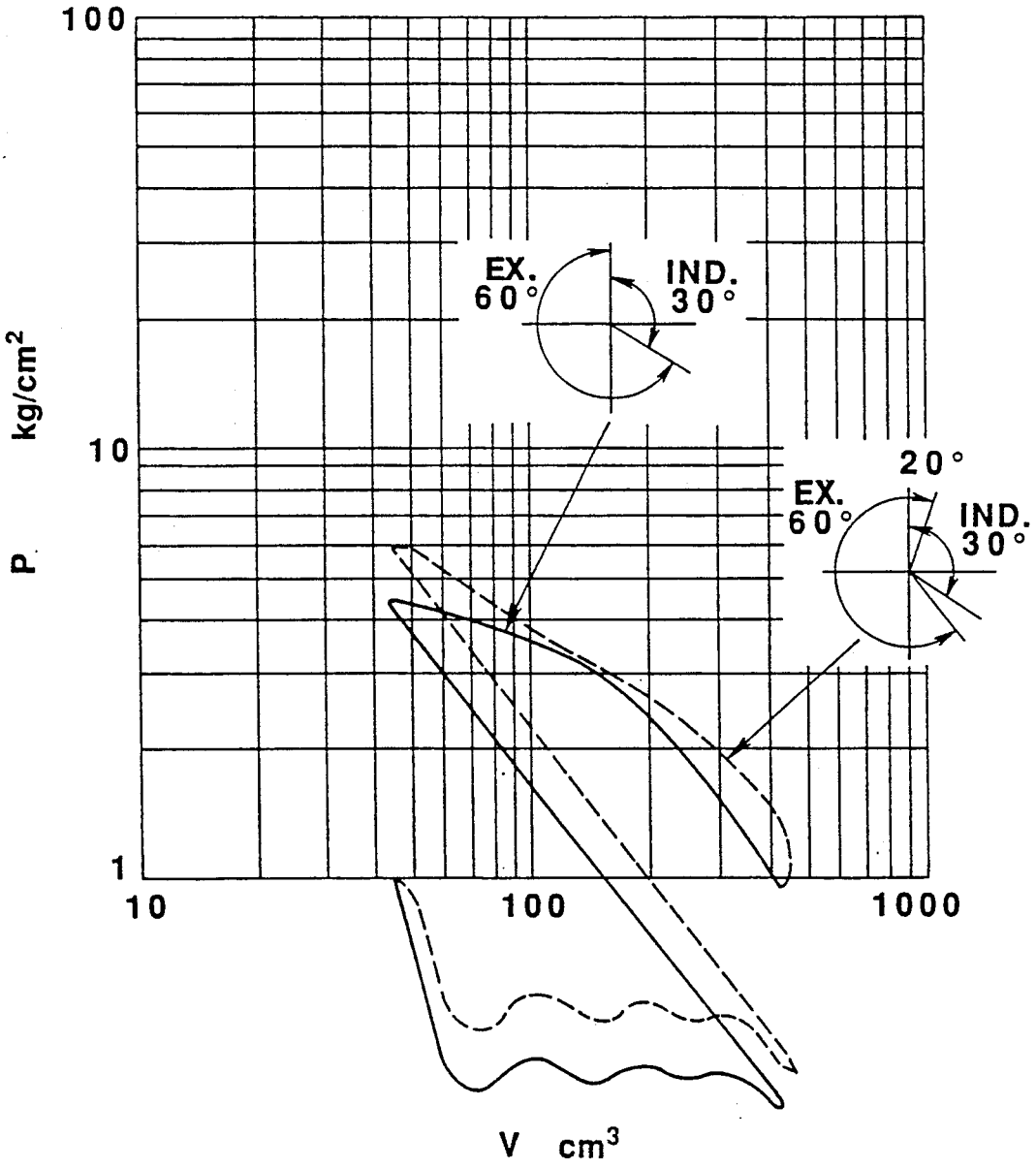
FIGS. 7 to 10 are charts which show the various operational characteristics which are derived with the embodiment and how said characteristics vary with changes in valve timing/overlap.
Figure 8:
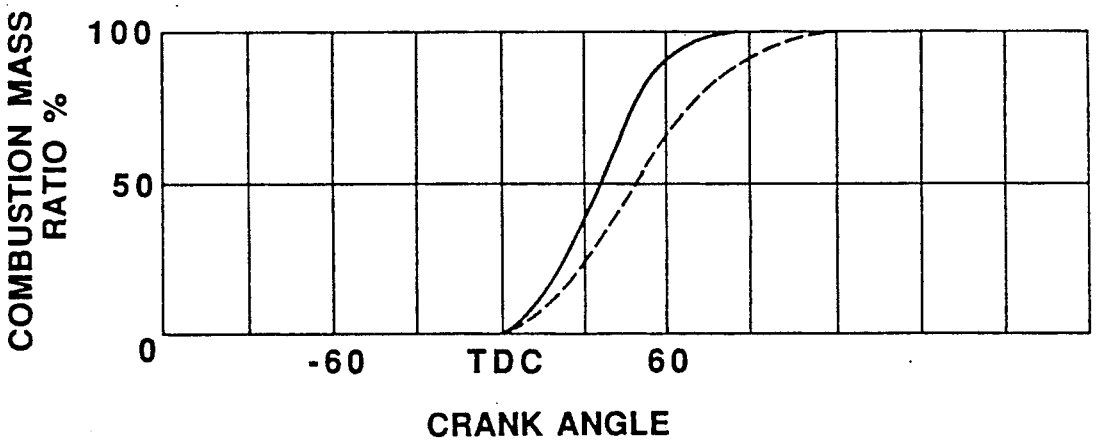
Figure 10:
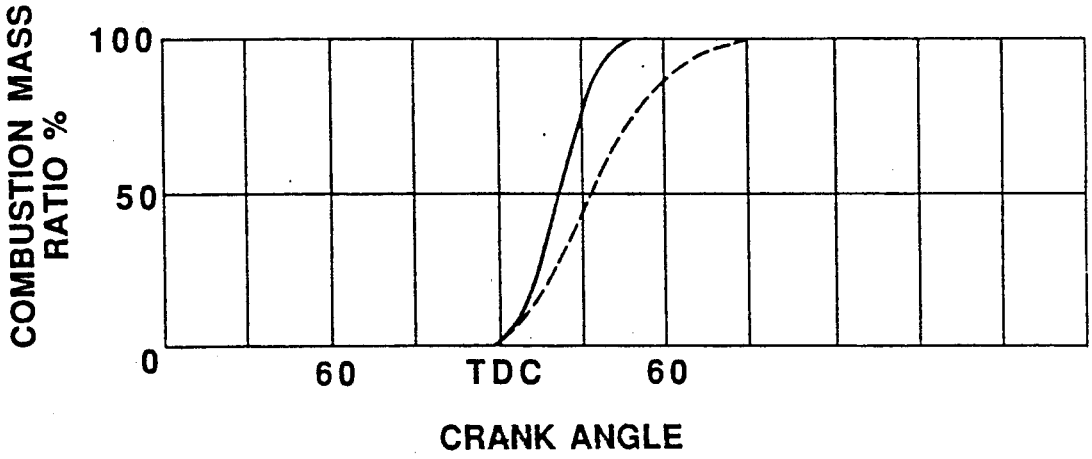
Figure 9:
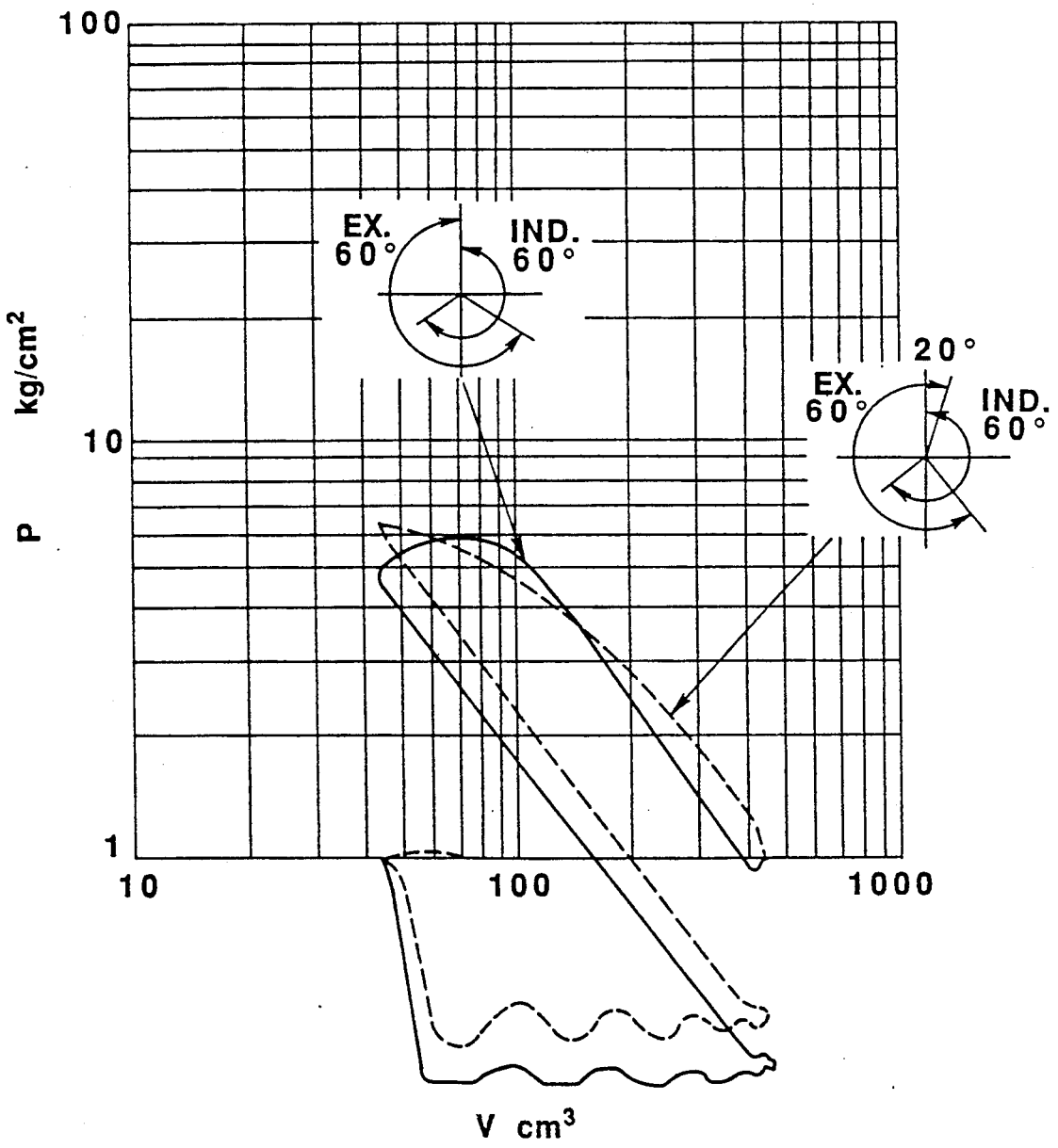

FIG. 7 and 8 show the situation wherein the inlet valves are opened over a 30° crank angle (e.g. the opening produced by the partial cam) in terms of combustion chamber pressure characteristics and combustion mass ratio. On the other hand, FIGS. 9 and 10 show the results obtained when the inlet valve is opened for a period of 60° (such as by the low speed cam) in terms of the same two parameters.

This data indicates that the longer inlet valve opening (i.e. 60°) permits the fuel to completely combust in a shorter time and to increase the amount of torque which is produced.

When the engine is started the output of the oil pump 104 is very low and even if the electromagnetic valve 202 provides fluid communication between the pump and the oil gallery passages 138 and 148, the pressure is insufficient to overcome the force of the return spring 48 of the low speed cam follower interlocking device and the pin 41 remains in the position illustrated in FIG. 1 wherein it locks the low speed follower against reciprocative movement with respect to the rocker arm 1. On the other hand, the high speed cam remains unlocked as insufficient pressure can be produced to move the pin 31 into a locking position. Accordingly, the low speed cam 22 determines the amount of lift during engine start up.

The low speed cam 22 produces a larger amount of lift than the partial cam 21 and maintains the valves open for a longer period. Accordingly, the amount of combustion of the fuel in the combustion chamber is increased promoting easy engine start and greatly attenuating the tendency for smouldering deposits to form on the spark plug electrodes.

In addition, if the hydraulic conduiting interconnecting the interlocking devices and the oil pump fail or the electromagnetic valve malfunctions in a manner which reduces and/or prevents the supply of pressurized hydraulic fluid to the hydraulic chambers 37, 47 of the high and low speed cam follower interlocking devices, the forces of the return spring 48 biases the spring cap 44 and the pin 41 into a locking position. Under these conditions the engine is able to be started and to produce sufficient torque for the vehicle to be driven to a service center.

What is claimed is:

1. In an internal combustion engine a cam shaft having first, second and third cams;

a rocker arm;

a first cam follower which is reciprocatively mounted on said rocker arm and arranged to engage said first cam;

a first interlocking device for selectively locking said first cam follower to said rocker arm and preventing relative movement therebetween in response to a first hydraulic signal having a first predetermined level;

a second cam follower which is reciprocatively mounted on said rocker arm and arranged to engage said second cam;

a second interlocking device for selectively locking said second cam follower to said rocker arm and preventing relative movement therebetween in response to the absence of a second hydraulic signal having a second predetermined level; and a third cam follower which is fixedly mounted on said rocker arm and arranged to engage said third cam.

2. In an internal combustion engine a cam shaft;

first, second and third cams on said cam shaft, said first cam being adapted to produce valve lift suited for high speed engine operation, said second cam being adapted to produce valve lift suited from low engine speed operation and said third cam being adapted to produce partial lift which is suited for optimizing fuel economy;

a rocker arm;

a first cam follower which engages said first cam and which is relatively movable with respect to said rocker arm;

a first interlocking device which normally permits relative movement between said first cam follower and said rocker arm, said first interlocking device locking said first cam follower to said rocker arm and preventing relative movement therebetween in response to a first predetermined hydraulic signal;

a second cam follower engages said second cam and which is relatively movable with respect to said rocker arm;

a second interlocking device which normally locks said second cam follower to said rocker arm and prevents relative movement therebetween, said second interlocking device releasing said second cam follower and permitting relative movement between said second cam follower and said rocker arm in response to a second predetermined hydraulic signal; and a third cam follower which is fixedly mounted on said rocker arm and arranged to engage said third cam.

3. An internal combustion engine as claimed in claim 2 wherein said first cam follower comprises:

a first follower portion and a first piston portion, the first piston portion having an essentially rectangular cross-section and reciprocatively received in a first essentially rectangular bore formed in said rocker arm; and wherein said first interlocking device comprises;

a first cylindrical through bore formed in said first piston portion, said first cylindrical bore having an axis which is essentially parallel with an axis of a rocker shaft on which said rocker arm is pivotally mounted;

second and third diametrically opposed cylindrical bores formed in said rocker arm in a manner to open into the first essentially rectangular bore;

a first pin reciprocatively disposed in said first cylindrical bore;

a first piston reciprocatively disposed in said second cylindrical bore in a manner to define a first control chamber into which said first predetermined hydraulic signal is supplied; and a first spring cap reciprocatively disposed in said third cylindrical bore in manner to enclose a return spring therein, said return spring producing a bias which in the absence of a first predetermined hydraulic pressure in the first control chamber, holds said first spring cap, first pin and first piston in positions which permits said first piston portion to reciprocate in said first essentially rectangular bore against the bias of a lost motion spring which is disposed in a lower portion of the first essentially rectangular bore.

4. An internal combustion engine as claimed in claim 2 wherein said second cam follower comprises:

a second follower portion and a second piston portion, the second piston portion having an essentially rectangular cross-section and reciprocatively received in a second essentially rectangular bore formed in said rocker arm; and wherein said second interlocking device comprises;

a fourth cylindrical through bore formed in said second piston portion, said fourth cylindrical bore having an axis which is essentially parallel with an axis of a rocker shaft on which said rocker arm is pivotally mounted;

fifth and sixth diametrically opposed cylindrical bores formed in said rocker arm in a manner to open into the second essentially rectangular bore;

a second pin reciprocatively disposed in said fourth cylindrical bore;

a second piston reciprocatively disposed in said fifth cylindrical bore in a manner to define a second control chamber into which said second predetermined hydraulic signal is supplied; and a second spring cap reciprocatively disposed in said sixth cylindrical bore in manner to enclose a second return spring therein, the second return spring producing a bias which in the absence of a second predetermined hydraulic pressure in the second control chamber, holds said second spring cap, second pin and second piston in positions which locks said second piston portion in a predetermined position in the second essentially rectangular bore and prevents reciprocation thereof against the bias of a lost motion spring which is disposed in a lower portion of the second essentially rectangular bore.

5. An internal combustion engine as claimed in claim 2 further comprising:

a rocker shaft on which said rocker arm is pivotally mounted;

a lubrication passage formed in said rocker shaft, said lubrication passage communicating with first, second and third cam follower lubrication passages which are formed in said rocker arm and which have ports which release lubricating oil in the near vicinity of the said first, second and third cam followers, respectively.

6. An internal combustion engine as claimed in claim 2 further comprising:

a rocker shaft on which said rocker arm is pivotally mounted;

first and second control passages formed in said rocker shaft, said first and second control passages fluidly communicating with first and second control chambers which form part of said first and second interlocking devices respectively, by way of first and second communication passages which are formed in said rocker arm and which lead from the first and second control chambers to first and second annular grooves formed in the surface of said rocker shaft, the first and second annular grooves being fluidly communicated with said first and second control passages.

7. An internal combustion engine as claimed in claim 6 further comprising:

a pump;

a valve which is interposed between the pump and said first and second control passages;

a control circuit which is responsive to engine speed and engine load indicative signals and which controls the operation of said valve in a manner wherein:

when the engine speed and engine load fall in a first predetermined zone, said control circuit conditions said valve to establish fluid communication between pump and said first control passage, when the engine speed and engine load fall in a second predetermined zone, communication between said pump and said first and second control passages is cut-off, and when the engine speed and engine load fall in a third predetermined zone communication between said pump and second second control passage is established.

8. An internal combustion engine as claimed in claim 2 wherein said rocker arm is arranged to simultaneously operate two poppet type valves.

* * * * *